US010731927B2

(12) United States Patent
Hayashi et al.

(10) Patent No.: US 10,731,927 B2
(45) Date of Patent: Aug. 4, 2020

(54) DUAL PLATE-TYPE HEAT EXCHANGER WITH REMOVABLE PLATES

(71) Applicant: MITSUBISHI HEAVY INDUSTRIES COMPRESSOR CORPORATION, Tokyo (JP)

(72) Inventors: Masahiro Hayashi, Hiroshima (JP); Tomoaki Takeda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 119 days.

(21) Appl. No.: 16/076,925

(22) PCT Filed: Feb. 9, 2016

(86) PCT No.: PCT/JP2016/000672
§ 371 (c)(1),
(2) Date: Aug. 9, 2018

(87) PCT Pub. No.: WO2017/138037
PCT Pub. Date: Aug. 17, 2017

(65) Prior Publication Data

US 2019/0049196 A1 Feb. 14, 2019

(51) Int. Cl.
*F28F 9/007* (2006.01)
*F28D 9/00* (2006.01)
(Continued)

(52) U.S. Cl.
CPC ..... *F28F 9/0075* (2013.01); *F28D 9/00* (2013.01); *F28D 9/0093* (2013.01); *F28F 3/08* (2013.01);
(Continued)

(58) Field of Classification Search
CPC ..... F28F 3/083; F28F 3/10; F28F 2275/20; F28F 2275/205; F28F 2280/02;
(Continued)

(56) References Cited

U.S. PATENT DOCUMENTS 2,252,916 A * 8/1941 Crosby ..... A23L 3/20 165/78
2,610,834 A * 9/1952 Dalzell ..... F28F 3/083 165/78
(Continued)

FOREIGN PATENT DOCUMENTS

JP S40-15265 Y1 6/1965
JP S59-042470 U 3/1984
(Continued)

OTHER PUBLICATIONS

International Search Report for corresponding International Application No. PCT/JP2016/000672, dated Apr. 26, 2016 (4 pages).
(Continued)

*Primary Examiner* — Jianying C Atkisson
*Assistant Examiner* — Jose O Class-Quinones
(74) *Attorney, Agent, or Firm* — Osha Liang LLP

(57) ABSTRACT

A plate-type heat exchanger includes a first heat exchange section and a second heat exchange section that includes a refrigerant flow path independent of the first heat exchange section. Each of the first and second heat exchange sections includes a fixed support supporting heat transfer plates from one end side in an arrangement direction, and a moving support supporting the heat transfer plates at a first support position on the other end side of the arrangement direction. The moving support is moved from the first support position to a retracted position separated in the arrangement direction to form a first removal region between the first support position and a second retracted position, and the heat trans-
(Continued)

fer plates are removed through the first removal region. The first removal region and the second removal region of the second heat exchange section are overlapped with each other.

2 Claims, 9 Drawing Sheets

(51) Int. Cl.
*F28F 3/08* (2006.01)
*F28F 9/00* (2006.01)

(52) U.S. Cl.
CPC ..... *F28F 3/083* (2013.01); *F28F 9/00* (2013.01); *F28F 9/007* (2013.01); *F28F 2275/205* (2013.01); *F28F 2280/02* (2013.01); *F28F 2280/06* (2013.01)

(58) Field of Classification Search
CPC ..... F28F 2280/04; F28F 2280/10; F28F 3/00; F28F 9/0075; F28F 9/00; F28F 2280/06; F28D 9/0081; F28D 9/0093; F28D 9/00
USPC ..... 29/890.03, 890.031, 890.039
See application file for complete search history.

(56) References Cited

U.S. PATENT DOCUMENTS 2,777,674 A * 1/1957 Wakeman ..... F28F 3/046 165/167
2,939,686 A * 6/1960 Wildermuth ..... F28F 3/083 165/167
3,099,520 A * 7/1963 Hallstrom ..... F28F 3/083 422/33
3,196,937 A * 7/1965 Jenssen ..... F28F 3/083 165/68
3,448,796 A * 6/1969 Usher ..... F28F 3/083 165/78
3,666,226 A * 5/1972 Johansson ..... F28F 3/083 248/214
3,862,661 A * 1/1975 Kovalenko ..... F28F 3/046 165/167
4,090,556 A * 5/1978 Almqvist ..... B01D 25/172 165/167
6,899,163 B2 * 5/2005 Finch ..... F28F 3/083 165/166
2013/0284412 A1 10/2013 Forstenius et al.

FOREIGN PATENT DOCUMENTS

JP S61-161577 U 10/1986
JP H03-91695 A 4/1991
JP H03-112659 U 11/1991
JP H06-088691 A 3/1994
JP H06-094387 A 4/1994
JP 2014-505224 A 2/2014

OTHER PUBLICATIONS

International Preliminary Report on Patentability for corresponding International Application No. PCT/JP2016/000672, dated Aug. 23, 2018 (7 pages).

* cited by examiner

DUAL PLATE-TYPE HEAT EXCHANGER WITH REMOVABLE PLATES

TECHNICAL FIELD

The present invention relates to a plate-type heat exchanger.

BACKGROUND ART

A plate-type heat exchanger includes a fixed support and a moving support in a heat exchange section, and the moving support is attached to be movable in a long axis direction of a guide bar. Heat transfer plates are stacked and attached between a fixed plate and a moving plate. Each of the heat transfer plates is provided with irregularity through press processing and is provided with a sealing gasket. Therefore, a flow path through which a heat source flows and a refrigerant flow path through which working fluid different in temperature from the heat source flows are alternately formed in gaps caused by stacking of the heat transfer plates. The heat source and the working fluid flow through these flow paths, which results in highly-efficient heat exchange.

The heat transfer plates and the gaskets attached to the plate-type heat exchanger are removed for maintenance of the plate-type heat exchanger. At this time, for removal of the heat transfer plate, the moving support is moved in the long axis direction of the guide bar, and the guide bar is disengaged from a guide groove provided on the heat transfer plate by, for example, inclining the heat transfer plate. Accordingly, in the plate-type heat exchanger, a removal region where the moving support is moved for removal of the heat transfer frames and the heat transfer frames are removed is secured. The removal region is not used for other purposes during normal operation and is used only during maintenance and inspection that are not frequently performed, because the guide bar and the like are always provided in the removal region. As described above, the removal region secured in the plate-type heat exchanger unnecessarily occupies an installation space of the plate-type heat exchanger during normal operation.

Patent Literature 1 discloses a plate-type heat exchanger in which the heat transfer plates between the fixed support and the moving support are fastened and fixed by fastening metals. Each of the fastening metals includes, at both ends of a sleeve with a predetermined length, a nut to which a bolt has been screwed and fixed and a nut to which a bolt has been screwed and inserted. According to the plate-type heat exchanger disclosed in Patent Literature 1, the bolt is not protruded from the moving support. Therefore, the removal region is effectively usable for other purposes during normal operation.

CITATION LIST

Patent Literature

Patent Literature 1: JP 6-88691 A

SUMMARY OF INVENTION

Technical Problem

It is desirable to continue heat exchange if any problem occurs on the heat exchange section. Therefore, a plurality of heat exchange sections are provided on a plurality of plate-type heat exchangers, typically, on two plate-type heat exchangers, one of the plate-type heat exchangers serves as a main heat exchanger, and the other serves as a sub-heat exchanger. The heat exchange is preferably performed by the main heat exchanger at a normal time, and if any problem occurs, the heat exchanger is changed over to the sub-heat exchanger to perform the heat exchange. When the two plate-type heat exchangers are disposed in a simple layout, the removal regions as many as the number of disposed plate-type heat exchangers are necessary, which cannot meet a purpose requiring space saving.

Accordingly, an object of the present invention is to provide a heat exchanger that makes it possible to suppress a space occupied by removal regions while including two plate-type heat exchangers.

Solution to Problem

The present invention relates to a plate-type heat exchanger including a first heat exchange section and a second heat exchange section that includes a refrigerant flow path independent of the first heat exchange section.

The first heat exchange section according to the present invention includes a first fixed support and a first moving support. The first fixed support supports a plurality of arranged first heat transfer plates from one end side in an arrangement direction, the plurality of first heat transfer plates are arranged to cause heat transfer surfaces of adjacent first heat transfer plates to face each other, and the first moving support supports the plurality of first heat transfer plates at a first support position on one end side in the arrangement direction.

Further, in the first heat exchange section, the first moving support is moved from the first support position to a first retracted position separated in an arrangement direction to form a first removal region between the first support position and the first retracted position, and the first heat transfer plates are removed through the first removal region.

The second heat exchange section according to the present invention includes a second fixed support and a second moving support. The second fixed support supports a plurality of arranged second heat transfer plates from one end side in an arrangement direction, the plurality of second heat transfer plates are arranged to cause heat transfer surfaces of adjacent second heat transfer plates to face each other, and the second moving support supports the plurality of second heat transfer plates at a second support position on one end side in the arrangement direction.

Further, in the second heat exchange section, the second moving support is moved from the second support position to a second retracted position separated in the arrangement direction to form a second removal region between the second support position and the second retracted position, and the second heat transfer plates are removed through the second removal region.

Moreover, in the plate-type heat exchanger according to the present invention, the first removal region of the first heat exchange section and the second removal region of the second heat exchange section are overlapped with each other.

In the plate-type heat exchanger according to the present invention, the first heat exchange section and the second heat exchange section are preferably disposed to cause the first moving support of the first heat exchange section and the second moving support of the second heat exchange section to face each other.

In the plate-type heat exchanger according to the present invention, a dimension of the first removal region of the first heat exchange section in the arrangement direction and a dimension of the second removal region of the second heat exchange section in the arrangement direction are preferably equal to each other.

The plate-type heat exchanger according to the present invention preferably further includes a common guide that includes one end supported by the first fixed support of the first heat exchange section and the other end supported by the second fixed support of the second heat exchange section. The first moving support is preferably moved from the first support position to the first retracted position while being guided by the common guide, and the second moving support is preferably moved from the second support position to the second retracted position while being guided by the common guide.

In the plate-type heat exchanger according to the present invention, the common guide preferably includes a pair of upper and lower common guides provided at different positions in a height direction, the upper common guide is provided on a relatively upper part, and the lower common guide is provided on a lower part relative to the upper common guide. The first moving support and the second moving support are preferably suspended from and supported by the upper common guide, and the first moving support and the second moving support are preferably supported by the lower common guide from below in the height direction.

The plate-type heat exchanger according to the present invention preferably further includes a first independent guide that includes one end supported by the first fixed support of the first heat exchange section and the other end facing the first removal region, and a second independent guide that includes one end supported by the second fixed support of the second heat exchange section and the other end facing the second removal region. The first independent guide and the second independent guide are preferably disposed at positions, on one straight line, different from a position of the common guide, the first moving support and the second moving support are preferably suspended from and supported by the common guide, the first moving support is preferably supported by the first independent guide from below in the height direction, and the second moving support is preferably supported by the second independent guide from below in the height direction.

Advantageous Effects of Invention

According to the present invention, the removal region of the first heat exchange section and the removal region of the second heat exchange section are overlapped with each other, which makes it possible to suppress the space occupied by the removal regions of the entire heat exchanger including the first heat exchange section and the second heat exchange section. As a result, according to the heat exchanger of the present invention, for example, the heat exchange is performable by the first heat exchange section at a normal time, and if any problem occurs, the heat exchange section is changed over to the second heat exchange section to achieve the heat exchange in an application requiring space saving.

DESCRIPTION OF EMBODIMENTS

Figure 1A:
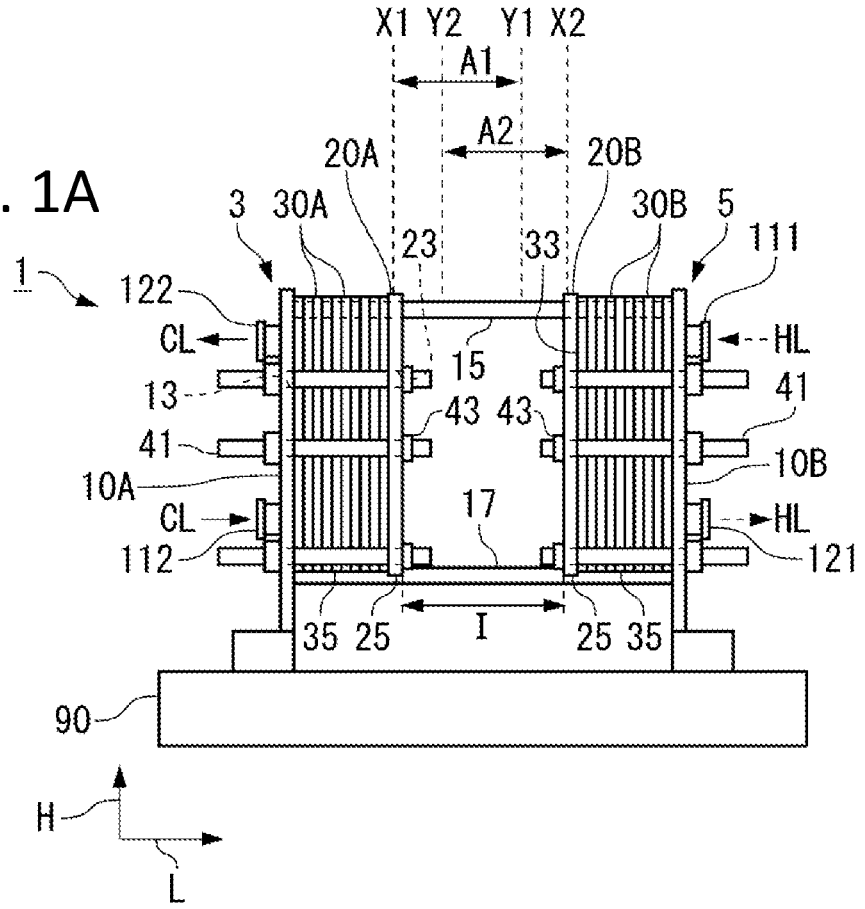
FIG. 1A is a front view illustrating a schematic configuration of a plate-type heat exchanger according to an embodiment of the present invention.

Some embodiments of a plate-type heat exchanger according to the present invention are described below with reference to accompanying drawings.

First Embodiment

As illustrated in FIG. 1, a plate-type heat exchanger 1 according to the present embodiment includes a first heat exchange section 3 and a second heat exchange section 5 that includes a refrigerant flow path independent of the first heat exchange section 3, and the first heat exchange section 3 and the second heat exchange section 5 are placed with an interval in a length direction L, on a surface plate 90. In each of the first heat exchange section 3 and the second heat exchange section 5, heat transfer plates 30 are arranged such that heat transfer surfaces 33 of the respective heat transfer plates 30 adjacent to each other face each other, in a stacked state. A gasket (not illustrated) is disposed on each of the heat transfer surfaces 33. The heat transfer plates 30 arranged in such a manner are fastened and fixed by bolts 41 and nuts 43. The heat transfer plates 30 are fastened, which forms a flow path through which high-temperature fluid HL flows or a refrigerant flow path through which low-temperature fluid CL flows, between the heat transfer plates 30 and 30 adjacent to each other.

First, the first heat exchange section 3 is described. The first heat exchange section 3 includes a first fixed support 10A and a first moving support 20A. The first fixed support 10A supports a plurality of first heat transfer plates 30A from one end side in an arrangement direction, and the first moving support 20A supports the plurality of first heat transfer plates 30A from the other end side in the arrangement direction.

Figure 1B:
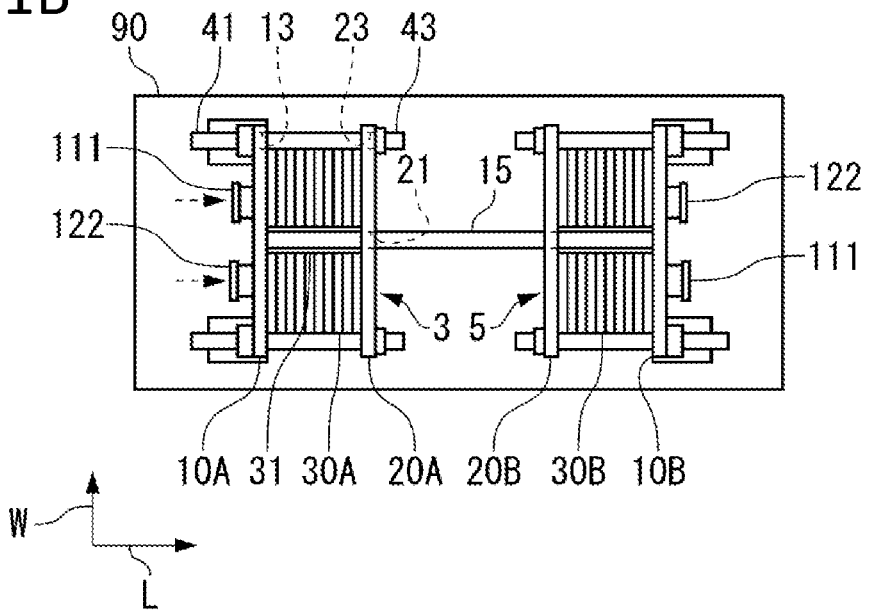
FIG. 1B is a plan view thereof.

As illustrated in FIGS. 1A and 1B, the first fixed support 10A includes a rectangular plate member. The first fixed support 10A stands on the surface plate 90 in a vertical direction such that a position thereof is fixed. The first fixed support 10A includes bolt holes 13 into which the bolts 41 are respectively inserted. The bolt holes 13 penetrate through front and rear surfaces of the first fixed support 10A.

In the present embodiment, as an example, the bolt holes 13 are provided at three positions in a height direction H and two positions in a width direction W, namely, at six positions in total as illustrated in FIGS. 1A and 1B.

The first fixed support 10A includes introduction paths 11 and discharge paths 12. The introduction paths 11 cause the high-temperature fluid HL and the low-temperature fluid CL to flow in from outside. The discharge paths 12 discharge the high-temperature fluid HL and the low-temperature fluid CL after heat exchange.

The introduction paths 11 are respectively provided at two positions with an interval in a diagonal direction of the first fixed support 10A, one introduction path 111 is used for introduction of the high-temperature fluid HL, and the other introduction path 112 is used for introduction of the low-temperature fluid CL.

The discharge paths 12 are also respectively provided at two positions with an interval in the diagonal direction of the first fixed support 10A, one of the discharge paths 12 (121) is used for discharge of the high-temperature fluid HL, and the other discharge path 12 (122) is used for discharge of the low-temperature fluid CL.

The introduction paths 11 and the discharge paths 12 described above are merely examples, and other arrangement is adoptable.

As illustrated in FIGS. 1A and 1B, the first moving support 20A includes a rectangular plate member. The first moving support 20A is provided so as to be movable in a length direction L by being supported by a pair of an upper guide 15 and a lower guide 17. Therefore, the first moving support 20A includes a guide hole 21 into which the upper guide 15 is inserted and a guide groove 25 into which the lower guide 17 is inserted. The guide hole 21 penetrates through front and rear surfaces of the first moving support 20A, and the guide groove 25 is provided at a lower end of the first moving support 20A. The first moving support 20A includes bolt holes 23 into which the bolts 41 are respectively inserted. The bolt holes 23 penetrate through the front and rear surfaces of the first moving support 20A. In the present embodiment, as an example, the bolt holes 23 are provided at three positions in the height direction H and two positions in the width direction W, namely, at six positions in total as illustrated in FIGS. 1A and 1B.

The first moving support 20A is disposed along the vertical direction and is parallel to the first fixed support 10A.

Further, the first moving support 20A is disposed at a first support position X1 that is a position separated from the first fixed support 10A by a total thickness of the plurality of first heat transfer plates 30A when the first fixed support 10A and the first moving support 20A support the plurality of first heat transfer plates 30A. The first moving support 20A is located at the first support position X1 during operation of the plate-type heat exchanger 1 to support, together with the first fixed support 10A, the first heat transfer plates 30A, whereas the first moving support 20A is moved to a first retracted position Y1 described later when maintenance and inspection of the plate-type heat exchanger 1 are performed.

The plurality of first heat transfer plates 30A each include a rectangular plate member, and are disposed and stacked between the first fixed support 10A and the first moving support 20A. In the stacked first heat transfer plates 30A, heat exchange is performed between the introduced high-temperature fluid HL and the introduced low-temperature fluid CL.

As illustrated in FIG. 1B, an upper guide groove 31 into which the upper guide 15 is inserted is provided at a center in the width direction W of upper ends of the respective first heat transfer plates 30A. Likewise, a lower guide groove 35 into which the lower guide 17 is inserted is provided at a center in the width direction W of lower ends of the respective first heat transfer plates 30A. When the upper guide 15 is inserted into the upper guide groove 31 and the lower guide 17 is inserted into the lower guide groove 35, the heat transfer plates 30 become movable while being guided by the upper guide 15 and the lower guide 17. The heat transfer plates 30 are moved when maintenance and inspection of the plate-type heat exchanger 1 are performed.

As illustrated in FIGS. 1A and 1B, the plurality of bolts 41 fasten, together with the corresponding nuts 43, the plurality of first heat transfer plates 30A through the first fixed support 10A and the first moving support 20A. Therefore, the bolts 41 are provided to penetrate through the bolt holes 13 of the first fixed support 10A and the bolt holes 23 of the first moving support 20A.

Each of the bolts 41 includes a length enough to be mated with the nut 43 to fasten the plurality of first heat transfer plates 30A through the first fixed support 10A and the first moving support 20A. Further, an outer diameter of each of the nuts 43 is larger than a diameter of each of the bolt holes 13 and a diameter of each of the bolt holes 23. As a result, a principle surface of the first moving support 20A around edges of the bolt holes 23 is pressed by the mated nuts 43 toward the first support position X1, and the first moving support 20A is moved to the first support position X1.

Next, the second heat exchange section 5 is described. The second heat exchange section 5 includes a configuration similar to that of the first heat exchange section 3. More specifically, the second heat exchange section 5 includes a second fixed support 10B and a second moving support 20B. The second fixed support 10B supports a plurality of second heat transfer plates 30B from one end side in an arrangement direction, and the second moving support 20B supports the plurality of second heat transfer plates 30B from the other end side in the arrangement direction. As with the first moving support 20A, the second moving support 20B is moved from a second support position X2 to a second retracted position Y2 (see FIG. 1A) when maintenance and inspection of the plate-type heat exchanger 1 are performed. In the present embodiment, the first heat exchange section 3 and the second heat exchange section 5 each include the same number of heat transfer plates 30 with the same specification.

In the present embodiment, the second heat transfer plates 30B are the same as the first heat transfer plates 30A, the second fixed support 10B is the same as the first fixed support 10A, and the second moving support 20B is the same as the first moving support 20A; however, the second heat exchange section 5 may use components different from those of the first heat exchange section 3.

As illustrated in FIGS. 1A and 1B, the upper guide 15 is a rod-like member. The moving supports 20 of the first heat exchange section 3 and the second heat exchange section 5 are suspended from and supported by the upper guide 15.

One end of the upper guide 15 is fixed to the first fixed support 10A of the first heat exchange section 3, and the other end is fixed to the second fixed support 10B of the second heat exchange section 5. The upper guide 15 is provided over the first heat exchange section 3 and the second heat exchange section 5. The upper guide 15 is disposed such that an axis direction thereof is parallel to the arrangement direction of the first heat transfer plates 30A and the second moving support 20B and extends along the length direction L.

The upper guide 15 is inserted into the guide holes 21 of the first moving support 20A and the second moving support 20B without a gap, which makes the first moving support 20A and the second moving support 20B movable in the length direction L while being guided by the upper guide 15. As described above, in the present embodiment, the upper guide 15 serves as a common guide at an upper part that makes the first moving support 20A and the second moving support 20B movable in the length direction L, namely, serves as the upper common guide.

Note that a shape of a cross-section of the upper guide 15 is not limited, and a circular shape, a rectangular shape, or the like is appropriately selectable. This is true of the lower guide 17.

As illustrated in FIGS. 1A and 1B, the lower guide 17 is a rod-like member that supports movement of the moving supports 20 of the first heat exchange section 3 and the second heat exchange section 5 and the plurality of heat transfer plates 30 from below.

One end of the lower guide 17 is fixed to the first fixed support 10A of the first heat exchange section 3, and the other end is fixed to the second fixed support 10B of the second heat exchange section 5. The lower guide 17 is provided over the first heat exchange section 3 and the second heat exchange section 5.

The lower guide 17 is preferably inserted into the guide groove 25 of each of the first moving support 20A and the second moving support 20B and the lower guide groove 35 of the heat transfer plates 30 without a gap. As a result, the first moving support 20A and the second moving support 20B are movable in the length direction L while being guided by the lower guide 17. The lower guide 17 is disposed such that an axis direction thereof is parallel to the arrangement direction of the heat transfer plates 30 and extends along the length direction L. As described above, in the present embodiment, the lower guide 17 serves as a common guide to move the first moving support 20A and the second moving support 20B in the length direction L. In other words, the lower guide 17 serves as a lower common guide provided at a lower part relative to the upper common guide (upper guide 15).

In the plate-type heat exchanger 1 including the above-described configuration, the first heat exchange section 3 and the second heat exchange section 5 are coupled to each other by the upper guide 15 and the lower guide 17 as illustrated in FIGS. 1A and 1B. Each of the upper guide 15 and the lower guide 17 includes a length enough to couple the first heat exchange section 3 and the second heat exchange section 5 through a first removal region A1 and a second removal region A2.

Figure 2A:
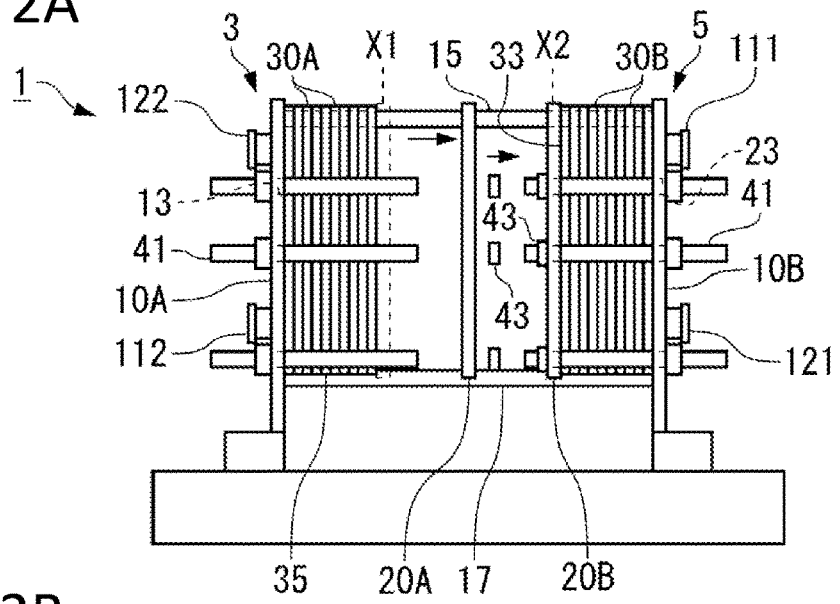
FIGS. 2A to 2C stepwisely illustrate a process of removing heat transfer plates in the embodiment of FIGS. 1A and 1B.
Figure 2B:
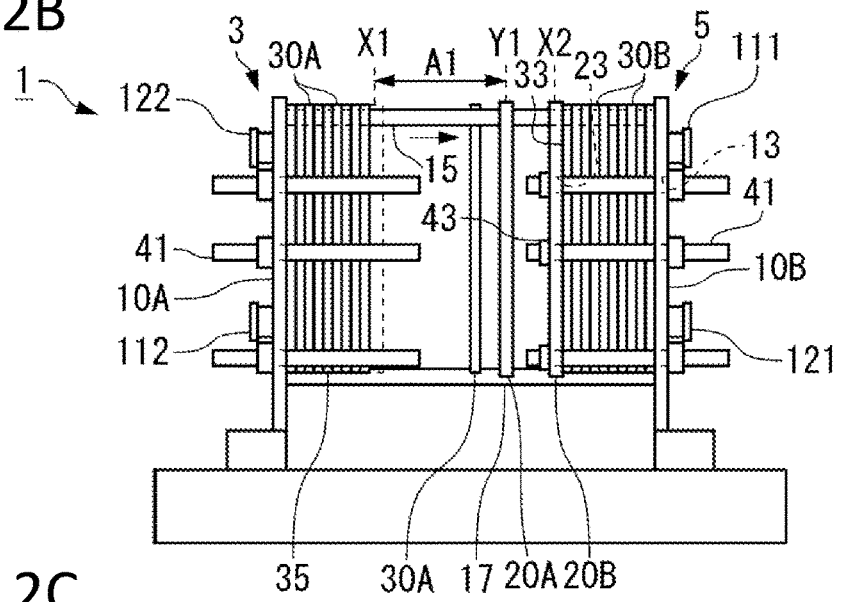

Further, as illustrated in FIG. 2B, the first moving support 20A is movable from the first support position X1 to the first retracted position Y1 while being guided by the upper guide 15 and the lower guide 17 when maintenance and inspection of the plate-type heat exchanger 1 are performed. The first retracted position Y1 is separated from the first support position X1 by a predetermined distance in the arrangement direction of the first heat transfer plates 30A. When the first heat transfer plates 30A are moved to the first retracted position Y1, the first removal region A1 for removal operation of the first heat transfer plates 30A is formed. Accordingly, the distance from the first support position X1 to the first retracted position Y1, namely, a dimension of the first removal region A1 in the length direction L is set to a dimension enough for removal of the first heat transfer plates 30A.

Note that, although FIG. 2B illustrates an example in a case where the first moving support 20A of the first heat exchange section 3 is moved, the second moving support 20B of the second heat exchange section 5 is moved in an opposite direction and reaches the second retracted position Y2. As a result, the second removal region A2 is formed between the second support position X2 and the second retracted position Y2 (see FIG. 1A). The second removal region A2 is set in a manner similar to the first removal region A1. In the present embodiment, since the first heat exchange section 3 and the second heat exchange section 5 each include the same number of heat transfer plates 30 with the same specification, the dimension of the first removal region A1 and the dimension of the second removal region A2 in the length direction L are equal to each other.

$$A1=A2$$

As illustrated in FIG. 1A, the first heat exchange section 3 and the second heat exchange section 5 are disposed such that the first moving support 20A and the second moving support 20B face each other. A distance I between the first moving support 20A and the second moving support 20B is smaller than a total length of the first removal region A1 and the second removal region A2. Accordingly, the first removal region A1 and the second removal region A2 are partially overlapped with each other. Thus, when the first moving support 20A is moved to the first retracted position Y1, the first moving support 20A is moved in the first removal region A1 and the second removal region A2 as well. Likewise, when the second moving support 20B is moved to the second retracted position Y2, the second moving support 20B is moved in the second removal region A2 and the first removal region A1 as well. As described above, the first heat exchange section 3 and the second heat exchange section 5 share a part of the first removal region A1 and a part of the second removal region A2 with each other.

$$I<A1+A2$$

The distance I is preferably equal to a larger one of the dimension of the first removal region A1 and the dimension of the second removal region A2 in the length direction L. This allows the first heat exchange section 3 and the second heat exchange section 5 to share both removal regions A while reducing the distance I.

In the present embodiment, the distance I is slightly larger than the dimension of the first removal region A1 (second removal region A2) in the length direction L. This allows the first heat exchange section 3 and the second heat exchange section 5 to share the first removal region A1 and the second removal region A2 by a larger amount.

In the plate-type heat exchanger 1 according to the present embodiment, the first heat exchange section 3 and the second heat exchange section 5 are disposed such that the center of the first moving support 20A and the center of the second moving support 20B are located on the same straight line in a side view (see FIG. 1A) and in a planar view (see FIG. 1B). This makes it possible to surely overlap the first removal region A1 and the second removal region A2.

Figure 2C:
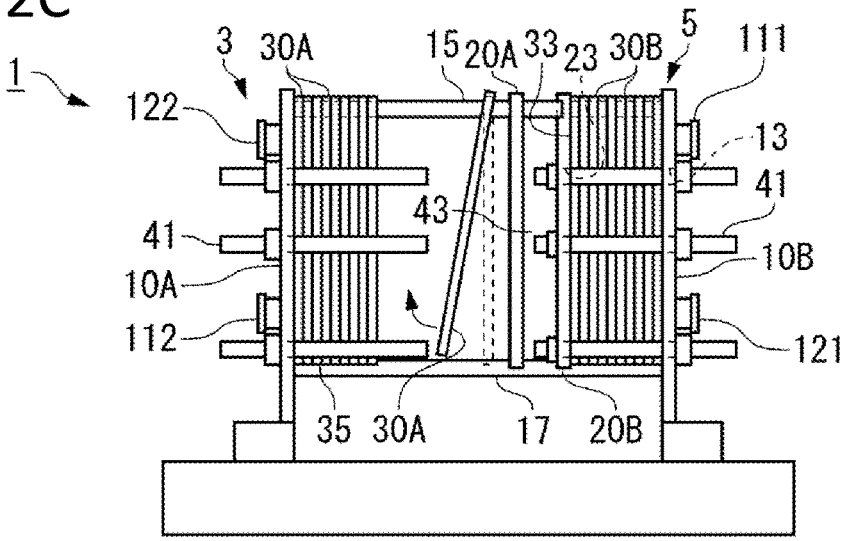

Next, a procedure of removing the heat transfer plates 30 of the plate-type heat exchanger 1, for example, during maintenance and inspection is described with reference to FIGS. 2A to 2C. FIGS. 2A to 2C each illustrate a process of removing the first heat transfer plates 30A from the first heat exchange section 3.

First, as illustrated in FIG. 2A, all of the nuts 43 involved in fastening of the first moving support 20A are removed and fastening of the first moving support 20A by the bolts 41 and the nuts 43 are released to make the first moving support 20A movable toward the first retracted position Y1. Further, the first moving support 20A is moved from the first support position X1 to the first retracted position Y1 to form the first removal region A1. In the movement, the first moving support 20A can be smoothly moved to the retracted position Y because the first moving support 20A is supported and guided by the upper guide 15 and the lower guide 17.

Next, as illustrated in FIG. 2B, the first heat transfer plate 30A to be removed is moved to the first removal region A1. In the movement, the first heat transfer plate 30A is guided by the lower guide 17 through the lower guide groove 35. Thereafter, as illustrated in FIG. 2C, the moved first heat transfer plate 30A is inclined within the first removal region A1 to disengage the lower guide groove 35 of the first heat transfer plate 30A from the lower guide 17. Further, the first heat transfer plate 30A disengaged from the lower guide 17 is pulled out forward and is removed from the first heat exchange section 3. The first heat transfer plates 30A are removed one by one in such a manner that each of the first heat transfer plates 30A is moved to the first removal region A1 in an order of proximity to the first moving support 20A moved in the first retracted position Y1.

Removal of the second heat transfer plates 30B of the second heat exchange section 5 is performable in a manner similar to the first heat exchange section 3 even though the second moving support 20B and the second heat transfer plates 30B are moved in an opposite direction.

Effects achieved by the plate-type heat exchanger 1 according to the present embodiment are described below.

Although the plate-type heat exchanger 1 includes the two heat exchangers of the first heat exchange section 3 and the second heat exchange section 5, the first removal region A1 of the first heat exchange section 3 and the second removal region A2 of the second heat exchange section 5 are overlapped with each other. Accordingly, the space occupied by the plate-type heat exchanger 1 is suppressed as compared with a case where the first removal region A1 and the second removal region A2 are independently provided at different places. Therefore, the plate-type heat exchanger 1 is suitably used even in a case where an installation space is limited in, for example, a plant on the sea.

Further, since the plate-type heat exchanger 1 includes the first heat exchange section 3 and the second heat exchange section 5 as the two heat exchangers, it is possible to use one of the two heat exchangers as a main heat exchanger and to use the other as a sub-heat exchanger. Therefore, for example, the heat exchange is performable with use of the first heat exchange section 3 as the main heat exchanger at a normal time, and if any problem occurs on the first heat exchange section 3, the heat exchanger is changed over to the second heat exchange section 5 as the sub-heat exchanger to perform heat exchange. As a result, the plate-type heat exchanger 1 can continue heat exchange even if problem such as failure occurs on one of the heat exchangers.

Further, in the plate-type heat exchanger 1, the moving support 20 of the first heat exchange section 3 and the moving support 20 of the second heat exchange section 5 face each other and are disposed such that the centers of the respective moving supports 20 are located on the same straight line as illustrated in FIGS. 1A and 1B. This allows the first heat exchange section 3 and the second heat exchange section 5 that are disposed side by side on the straight line, to share the first removal region A1 and the second removal region A2. Accordingly, adjustment of the distance between the first heat exchange section 3 and the second heat exchange section 5 allows for overlapping of the large parts of the first removal region A1 and the second removal region A2. This makes it possible to minimize the dimension of the plate-type heat exchanger 1 in the length direction L. Ideally, the entire first removal region A1 and the entire second removal region A2 are overlapped with each other to minimize the space occupied by the first removal region A1 and the second removal region A2. Overlapping of the entire first removal region A1 and the entire second removal region A2, however, is often difficult because the space for installation of the bolts 41 protruded from the moving supports 20 and the nuts 43 mated with the bolts 41 is necessary. On the other hand, in the present embodiment, the large part of the first removal region A1 and the large part of the second removal region A2 are overlapped with each other. The present invention, however, is not limited thereto, and for example, even when the first removal region A1 and the second removal region A2 are overlapped by ½ with each other, it is possible to save the space occupied by the removal regions by ½. The space occupied by the removal regions is largely saved as the range where the first removal region A1 and the second removal region A2 are overlapped with each other is larger as a matter of course.

Moreover, the plate-type heat exchanger 1 includes the upper guide 15 provided over the first heat exchange section 3 and the second heat exchange section 5, and the first moving support 20A and the second moving support 20B are movable while being guided by the upper guide 15. The configuration allows the moving support 20 of each of the first heat exchange section 3 and the second heat exchange section 5 to be moved between the first support position X1 and the first retracted position Y1 and between the second support position X2 and the second retracted position Y2 without removal. Therefore, it is possible to reduce work burden to remove the heat transfer plates 30.

Figure 3A:
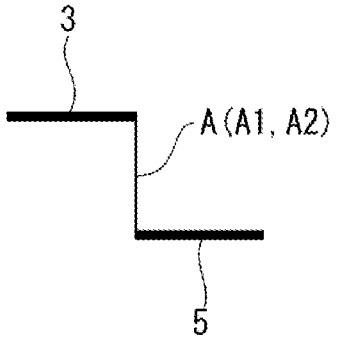
FIGS. 3A to 3C are plan views each illustrating an outline of a plate-type heat exchanger according to another embodiment of the present invention.
Figure 3B:
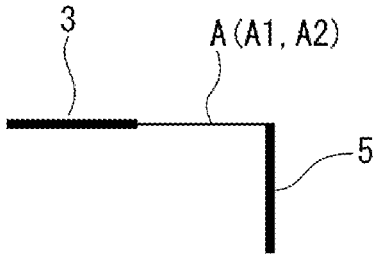
Figure 3C:
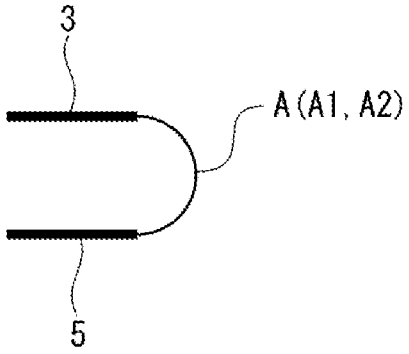

In the first embodiment, the example in which the first heat exchange section 3 and the second heat exchange section 5 of the plate-type heat exchanger 1 are disposed on the same straight line has been described as illustrated in FIGS. 1A and 1B however, the two heat exchangers may not be disposed on the same straight line as long as the removal regions A are shared. For example, as illustrated in FIGS. 3A to 3C, the plate-type heat exchanger 1 may include a crunch shape, an L-shape, or a U-shape in a planar view. This allows for effective use of environment around an installation place of the plate-type heat exchanger 1 in some cases.

Figure 4:
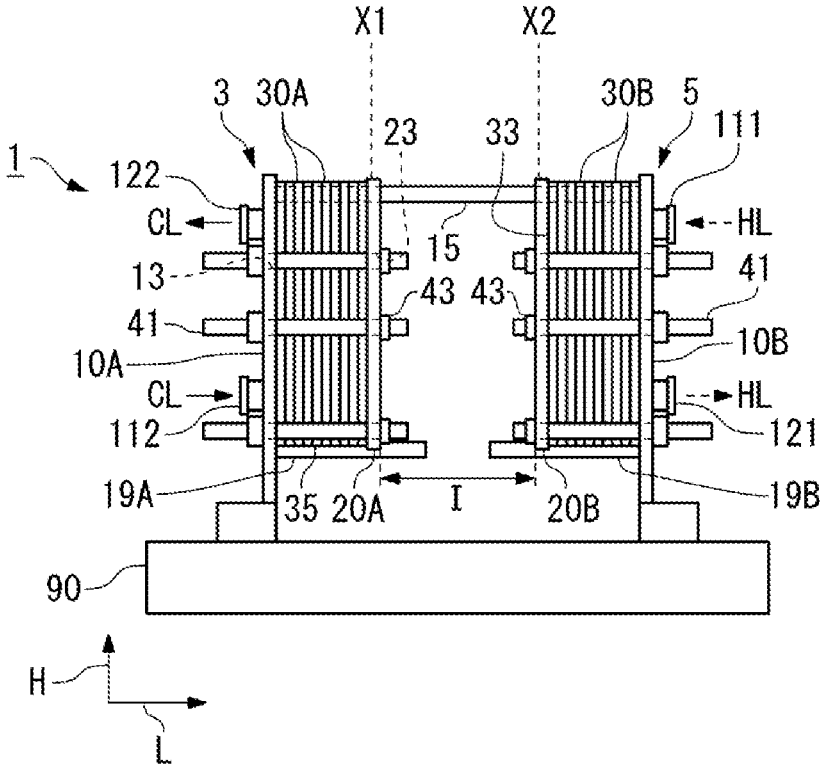
FIG. 4 is a front view illustrating a schematic configuration of a plate-type heat exchanger according to another embodiment of the present invention.

In the present embodiment, the lower guide 17 is used as the lower common guide for the first heat exchange section 3 and the second heat exchange section 5; however, the lower guide 17 may be lacked at a place where the first removal region A1 and the second removal region A2 are overlapped with each other. In this case, as illustrated in FIG. 4, a first independent guide 19A that includes one end supported by the first fixed support 10A and the other end facing the first removal region A1 is provided in the first heat exchange section 3, and a second independent guide 19B that includes one end supported by the second fixed support 10B and the other end facing the second removal region A2 is provided in the second heat exchange section 5. Further, a gap is provided between a front end of the first independent guide 19A and a front end of the second independent guide 19B facing each other. As a result, it is possible to remove the heat transfer plates 30 only by moving the heat transfer plates 30 to the gap, without inclining the heat transfer plates 30.

In the present embodiment, the example in which the dimensions of the first removal region A1 and the second removal region A2 in the length direction L are equal to each other has been illustrated; however, such dimensions of the first removal region A1 and the second removal region A2 may be different from each other. For example, in a case where the number of heat transfer plates 30 installed in one of the first heat exchange section 3 and the second heat exchange section 5 is made larger than that of the other heat exchange section, the dimension of one of the first removal region A1 and the second removal region A2 in the length direction L may be made larger than the dimension of the other according to the number of heat transfer plates 30. This makes it possible to provide, to the plate-type heat exchanger 1, a function of selectively using the first heat exchange section 3 and the second heat exchange section 5 different in the number of heat transfer plates 30, depending on a situation. Further, the plate-type heat exchanger 1 including the new function is also downsized because the removal regions A are shared between the first heat exchange section 3 and the second heat exchange section 5.

In the present embodiment, the upper guide 15 penetrates through the guide hole 21 of the moving support 20 and the moving support 20 is accordingly movable in the length direction L. Alternatively, a hole corresponding to the guide hole 21 may be provided in the lower guide 17 to allows for movement of the moving support 20. This eliminates necessity of installation of the upper guide 15, and makes it possible to remove the heat transfer plates 30 only through slight lifting of the heat transfer plates 30.

Second Embodiment

Next, a second embodiment of the present invention is described. Note that, in the second embodiment, components similar to those in the first embodiment are denoted by the same reference numerals as the first embodiment, and description of such components is omitted.

Figure 5:
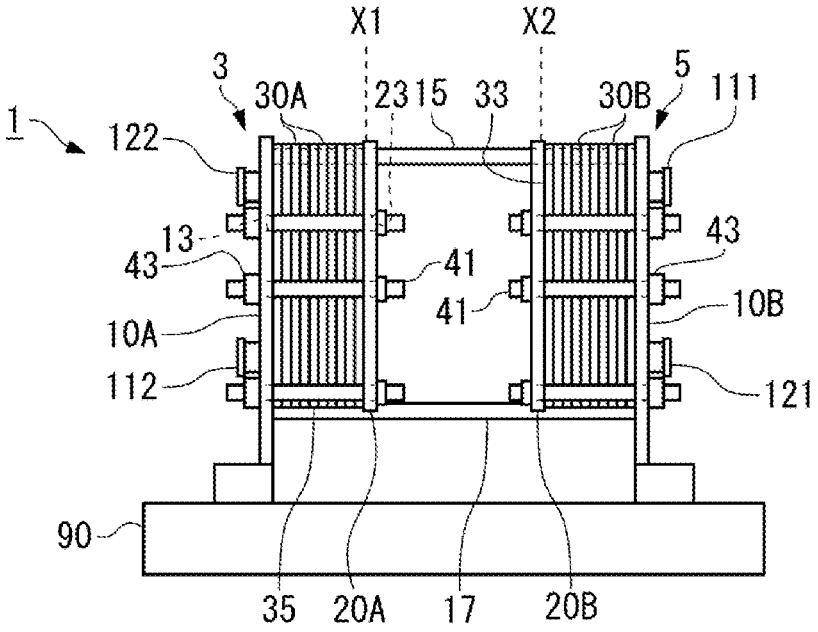
FIG. 5 is a front view illustrating a schematic configuration of a plate-type heat exchanger according to still another embodiment of the present invention.

As illustrated in FIG. 5, the bolts 41 used in the second embodiment penetrate through the bolt holes 23 and the bolt holes 13 in order. Further, the nuts 43 mated with the bolts 41 are pressed against the principle surface provided with the introduction paths 11 of the fixed support 10 and fasten the group of heat transfer plates 30. Each of the bolts 43 include a length such that a front end is protruded from the fixed support 10 and is mated with the corresponding nut 43.

In the plate-type heat exchanger 1 including the above-described configuration according to the present embodiment, the heat transfer plates 30 are removed in the following manner.

Figure 6A:
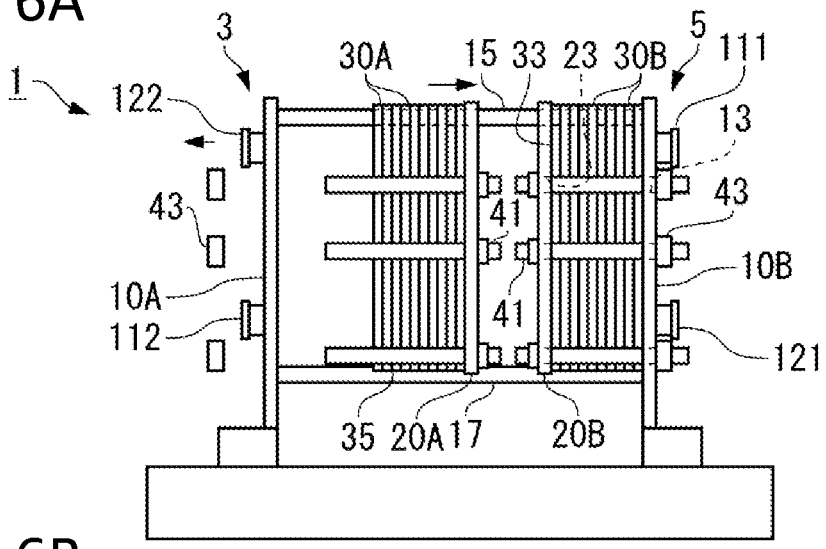
FIGS. 6A to 6C stepwisely illustrate a process of removing heat transfer plates in the embodiment illustrated in FIG. 5.

First, as illustrated in FIG. 6A, the nuts 43 are removed, and the moving support 20 that has become movable toward the retracted position Y and the group of stacked heat transfer plates 30 that has similarly become movable toward the retracted position Y are moved until the moving support 20 is located at the retracted position Y. As a result, the bolts 41 are respectively pulled out of the bolt holes 13, and the removal region A is formed between the fixed support 10 and the front ends of the respective bolts 41.

Figure 6B:
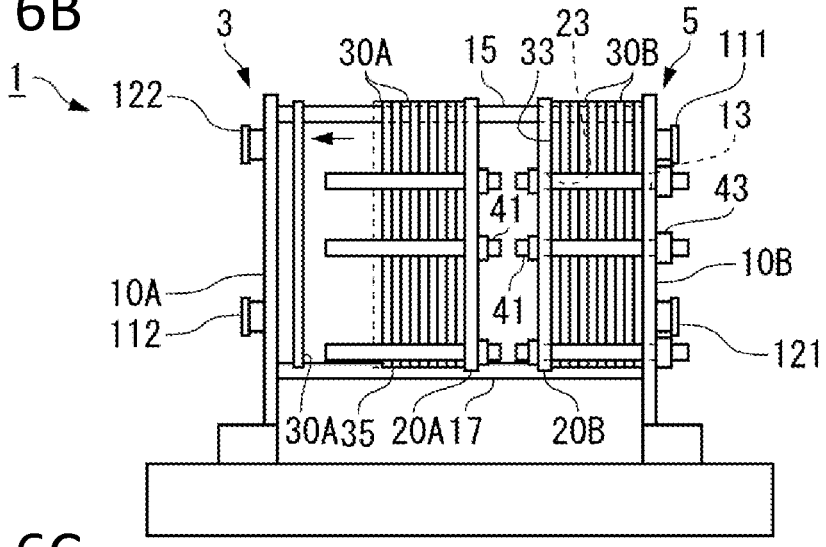
Figure 6C:
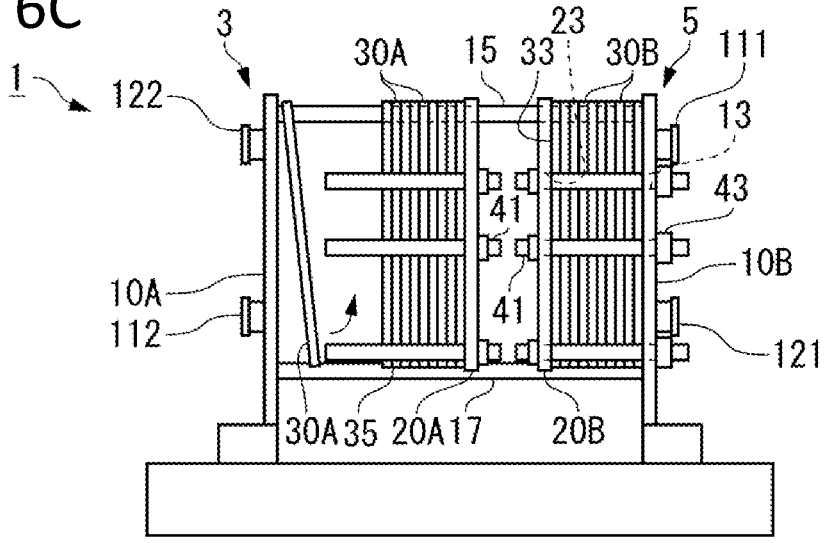

Next, as illustrated in FIG. 6B, each of the heat transfer plates 30 to be removed is moved toward the fixed support 10. Thereafter, as illustrated in FIG. 6C, the moved heat transfer plate 30 is inclined and the lower guide 17 is disengaged from the lower guide groove of the heat transfer plate 30. Further, the heat transfer plate 30 from which the lower guide 17 has been disengaged is pulled out forward and removed.

According to the present embodiment, the position of the group of heat transfer plates 30 is made different from a position of the plate-type heat exchanger 1 where the group of heat transfer plates 30 is attached at a normal time. This makes it possible to clearly represent, to a person other than an exchanger, that the removal work is ongoing.

Third Embodiment

Next, a third embodiment of the present invention is described. Note that, also in the third embodiment, components similar to those in the first embodiment are denoted by the same reference numerals as the first embodiment, and description of such components is omitted.

Figure 7:
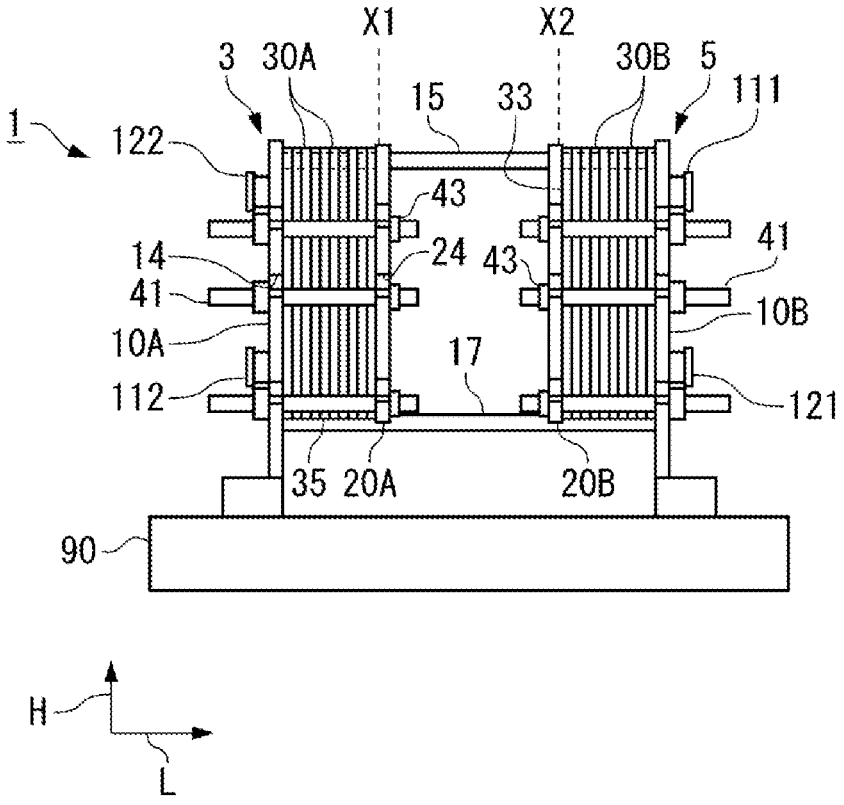
FIG. 7 is a front view illustrating a schematic configuration of a plate-type heat exchanger according to another embodiment of the present invention.

As illustrated in FIG. 7, the fixed support 10 used in the third embodiment does not include the bolt holes 13 but includes fitting grooves 14 into which the bolts 41 are respectively fitted. In addition, the moving support 20 does not include the bolt holes 23 but includes fitting grooves 24 into which the bolts 41 are respectively fitted. As a result, parts of the respective bolts 41 in a circumferential direction are fitted into the fitting grooves 14 and the fitting grooves 24 in a state where the nuts 43 are previously mated with the bolts 41, and the nuts 43 are further mated, which makes it possible to fix the bolts 41 and the nuts 43. Accordingly, it is possible to fasten and fix the group of heat transfer plates 30.

Figure 8A:
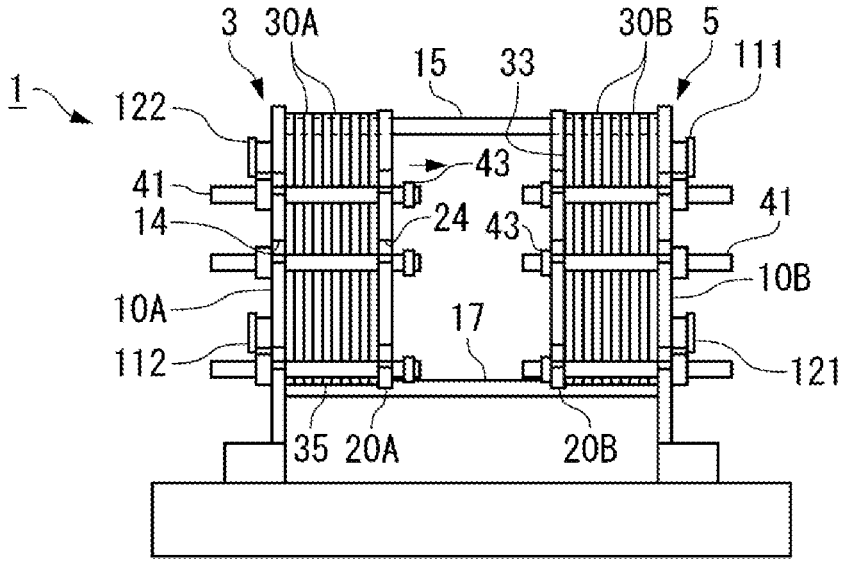
FIGS. 8A and 8B stepwisely illustrate a part of a process of removing heat transfer plates in the embodiment illustrated in FIG. 7.
Figure 8B:
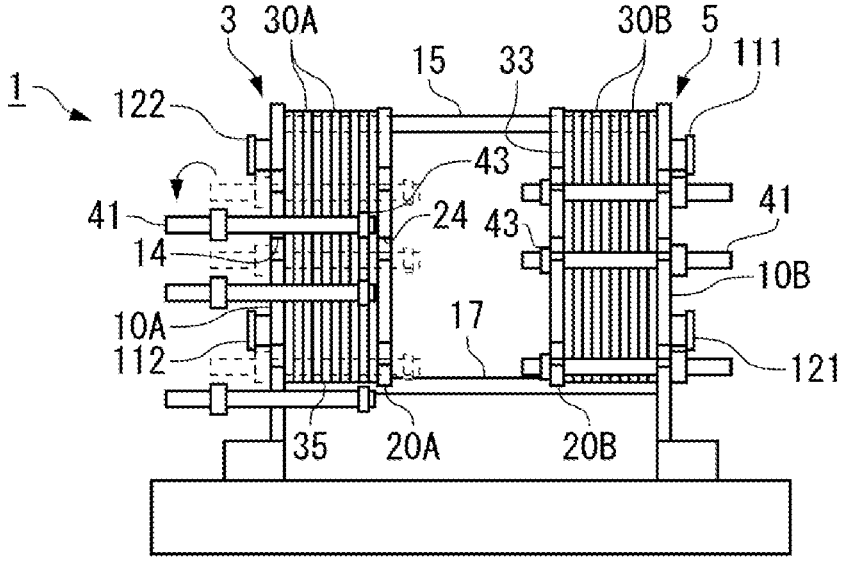

In the plate-type heat exchanger 1 including the above-described configuration according to the present embodiment, the heat transfer plates 30 are removed in the following manner. FIGS. 8A and 8B illustrate processes until the bolts 41 and the nuts 43 are removed, and FIGS. 9C to 9E illustrate processes until the heat transfer plates 30 are removed after the bolts 41 are removed.

First, to remove the bolts 41 and the nuts 43, the nuts 43 are loosened as illustrated in FIG. 8A and the bolts 41 and the nuts 43 are pulled out forward as illustrated in FIG. 8B. As a result, the bolts 41 are removed while being mated with the nuts 43.

Figure 9C:
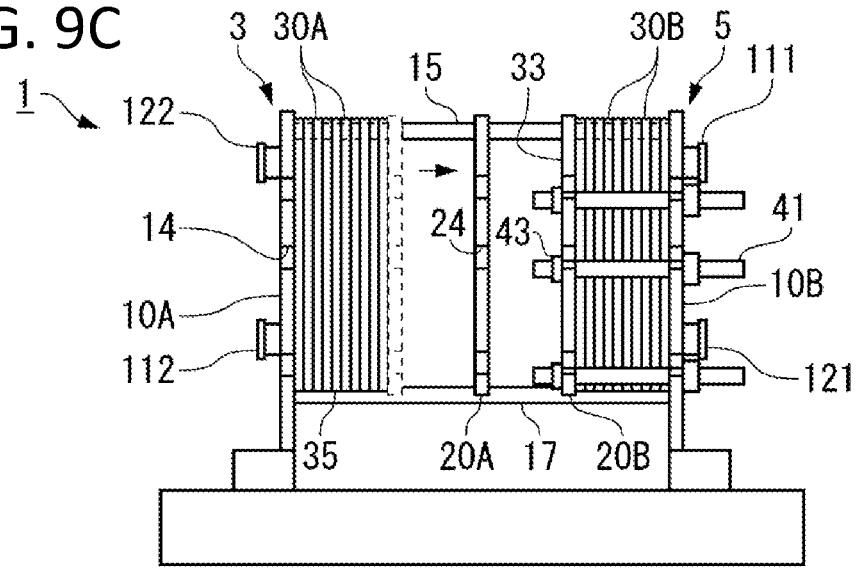
FIGS. 9C to 9E stepwisely illustrate a part of the process of removing the heat transfer plate in the embodiment illustrated in FIG. 7.
Figure 9D:
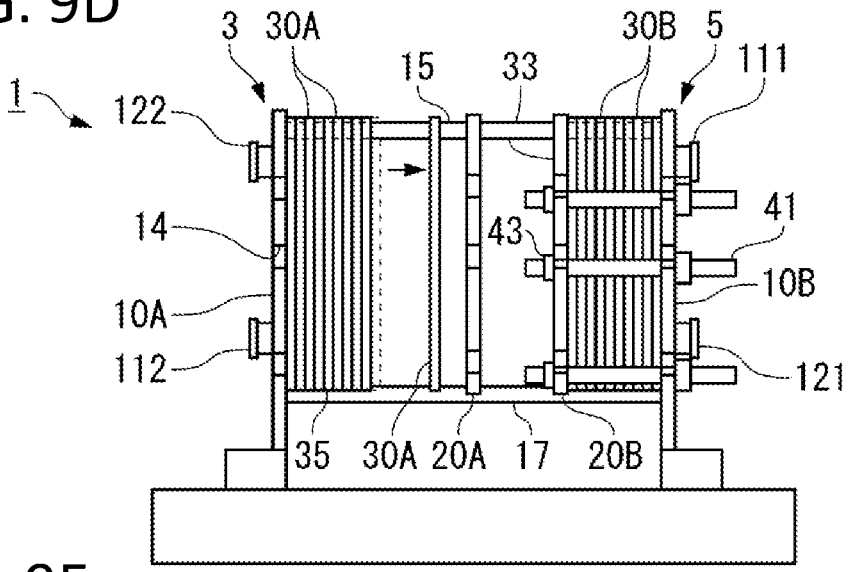
Figure 9E:
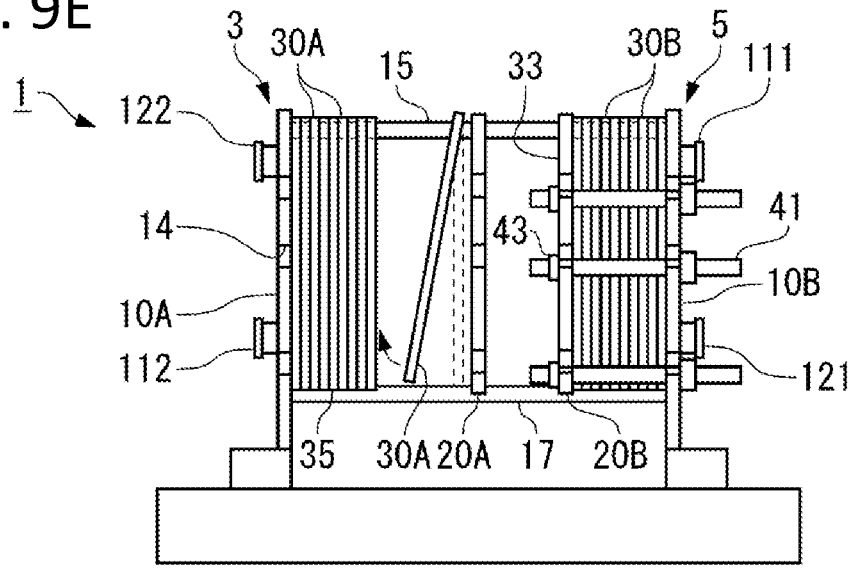

Next, as illustrated in FIG. 9C, the moving support 20 that has become movable toward the retracted position Y is moved to the retracted position Y. As a result, the removal region A is formed. Thereafter, as illustrated in FIG. 9D, the heat transfer plate 30 to be removed is moved into the formed removal region A. Further, as illustrated in FIG. 9E, the lower side of the moved heat transfer plate 30 is inclined, and the lower guide 17 is disengaged from the lower guide groove of the heat transfer plate 30. Thereafter, the heat transfer plate 30 from which the lower guide 17 has been disengaged is pulled out forward and removed.

According to the present embodiment, since the bolts 41 are removed, it is unnecessary to move the heat transfer plate 30 to the place where the bolts 41 are not present. Therefore, to disengage the lower guide 17 from the lower guide groove of the heat transfer plate 30, it is sufficient to move the heat transfer plate 30 by an amount enough to be inclined, which can reduce movement of the heat transfer plate 30. This makes it possible to reduce the removal regions A.

Although the present invention has been described hereinbefore based on the preferred embodiments, the configurations described in the above-described embodiments may be selected or appropriately modified without departing from the scope of the present invention.

REFERENCE SIGNS LIST

1 Plate-type heat exchanger
3 First heat exchange section

5 Second heat exchange section
10 Fixed support
10A First fixed support
10B Second fixed support
11 Introduction path
12 Discharge path
13 Bolt hole
14 Fitting groove
15 Upper guide
17 Lower guide
19A First independent guide
19B Second independent guide
20 Moving support
20A First moving support
20B Second moving support
21 Guide hole
23 Bolt hole
24 Fitting groove
25 Guide groove
30 Heat transfer plate
30A First heat transfer plate
30B Second heat transfer plate
31 Upper guide groove
33 Heat transfer surface
35 Lower guide groove
41 Bolt
43 Nut
90 Surface plate
A1 First removal region
A2 Second removal region
CL Low-temperature fluid
HL High-temperature fluid
X1 First support position
X2 Second support position
Y1 First retracted position
Y2 Second retracted position

The invention claimed is:

1. A plate-type heat exchanger including a first heat exchange section and a second heat exchange section that includes a refrigerant flow path independent of the first heat exchange section, wherein the first heat exchange section includes a first fixed support and a first moving support, the first fixed support supporting a plurality of arranged first heat transfer plates from one end side in an arrangement direction, the plurality of first heat transfer plates being arranged to cause heat transfer surfaces of adjacent first heat transfer plates to face each other, and the first moving support supporting the plurality of first heat transfer plates at a first support position on one end side in the arrangement direction, in the first heat exchange section, the first moving support is moveable from the first support position to a first retracted position separated in the arrangement direction to form a first removal region between the first support position and the first retracted position, and the first heat transfer plates are removable through the first removal region, the second heat exchange section includes a second fixed support and a second moving support, the second fixed support supporting a plurality of arranged second heat transfer plates from one end side in an arrangement direction, the plurality of second heat transfer plates being arranged to cause heat transfer surfaces of adjacent second heat transfer plates to face each other, and the second moving support supporting the plurality of second heat transfer plates at a second support position on one end side in the arrangement direction, in the second heat exchange section, the second moving support is moveable from the second support position to a second retracted position separated in the arrangement direction to form a second removal region between the second support position and the second retracted position, and the second heat transfer plates are removable through the second removal region, the first removal region of the first heat exchange section and the second removal region of the second heat exchange section are overlapped with each other, the first heat exchange section and the second heat exchange section are disposed to cause the first moving support of the first heat exchange section and the second moving support of the second heat exchange section to face each other, the plate-type heat exchanger further comprises a common guide that includes a first end supported by the first fixed support of the first heat exchange section and a second end supported by the second fixed support of the second heat exchange section, the first moving support is moveable from the first support position to the first retracted position while being guided by the common guide, the second moving support is moveable from the second support position to the second retracted position while being guided by the common guide, the plate-type heat exchanger further comprises a first independent guide that includes a first end supported by the first fixed support of the first heat exchange section and a second end facing the first removal region, a second independent guide includes a first end supported by the second fixed support of the second heat exchange section and a second end facing the second removal region, the common guide is provided on a relatively upper part, the first independent guide and the second independent guide are disposed at positions, on one straight line, different from a position of the common guide, the first moving support and the second moving support are suspended from and supported by the common guide, the first moving support is supported by the first independent guide from below in the height direction, and the second moving support is supported by the second independent guide from below in the height direction.

2. The plate-type heat exchanger according to claim 1, wherein a dimension of the first removal region of the first heat exchange section in the arrangement direction and a dimension of the second removal region of the second heat exchange section in the arrangement direction are equal to each other.

* * * * *